United States Patent [19]

Kolpin

[11] Patent Number: 4,965,486

[45] Date of Patent: Oct. 23, 1990

[54] ELECTRON GUN DESIGN USING A LANTHANUM HEXABORIDE CATHODE

[75] Inventor: Hans J. Kolpin, White Lake, Canada

[73] Assignee: Atomic Energy of Canada Limited, Otawa, Canada

[21] Appl. No.: 263,026

[22] Filed: Oct. 26, 1988

[30] Foreign Application Priority Data

Nov. 12, 1987 [CA] Canada ..... 551681

[51] Int. Cl.[5] ..... H01J 1/14; H01J 19/12

[52] U.S. Cl. ..... 313/270; 313/346 R; 313/346 DC

[58] Field of Search ..... 313/446, 451, 456, 346 R, 313/346 DC, 270, 337

[56] References Cited

U.S. PATENT DOCUMENTS

| | | | |
|---|---|---|---|
| 2,945,295 | 7/1960 | Feaster | 313/346 DC |
| 3,244,927 | 4/1966 | Drake et al. | 313/270 |
| 3,826,947 | 7/1974 | Bowes et al. | 313/268 |
| 4,147,954 | 4/1979 | Tuck | 313/337 |
| 4,215,457 | 8/1980 | Kuiper et al. | 29/25.14 |
| 4,429,250 | 1/1984 | Clerc et al. | 313/346 R |
| 4,621,213 | 11/1986 | Rand | 313/237 |

*Primary Examiner*—Sandra L. O'Shea

*Attorney, Agent, or Firm*—Brumbaugh, Graves, Donohue & Raymond

[57] ABSTRACT

A novel technique for mounting a disc of lanthanum hexaboride electron emission material within a hot cathode assembly of an electron gun is described. The disc is partly received in a recess of a graphite mounting member and the combined disc and mounting member are pushed to the end of a 50/50 molybdenum rhenium tube which has a rolled over lip which engages the disc. Indentations are formed in the tube and these extend into the mounting member to secure the mounting member to the tube. All contacting surfaces between the disc and mounting member and between the disc and lip are previously coated with colloidal graphite to improve electrical and thermal conductivity. Prior to securing the disc and mounting member to the tube the tube is secured to an alumina support ring by cutting and forming retaining lips from the tube and by flaring an end of the tube.

7 Claims, 3 Drawing Sheets

ELECTRON GUN DESIGN USING A LANTHANUM HEXABORIDE CATHODE

This invention relates to the mounting of an electron emissive material on the cathode of an electron discharge device such as an electron gun.

BACKGROUND OF THE INVENTION

An electron gun is a device which emits free electrons, shapes and accelerates them to form an electron beam. The physics design of an electron gun is usually done with the aid of modern computer codes which will predict the size and divergence of the beam for a given geometry and current. Examples of several different types of electron guns are the Rogowski gun, the telefocus gun and the Pierce gun.

Hot cathodes are the most frequently used emitters although many other materials emit free electrons. Several types of hot cathodes are commonly used in electron gun designs, such as tantalum wire or disc emitters, tungsten wire or disc emitters, thoriated carburized tungsten wire emitters, oxide cathodes, dispenser cathodes and lanthanum hexaboride ($LaB_6$) cathodes.

Some of the above types of cathodes in commercial use involve mounting the electron emissive material on a metal tube cathode which surrounds a cathode heater and which is secured by means of an insulating support disc to a surrounding control grid. See for example, U.S. Pat. Nos. 3,244,927 and 3,826,947. Neither of these patents disclose exactly how the electron emissive material is secured to the cathode tube but typically this would be done by brazing. U.S. Pat. No. 4,215,457 is directed to a specific technique for securing the electron emissive material to the cathode tube and according to one embodiment described this involves pressing a porous sintered molding of refractory metal impregnated with electron emissive material into a metal foil holder which partly overlaps a free surface of the molding. The holder is then welded to the tube.

The technique disclosed in U.S. Pat. No. 4,215,457 cannot be used for securing $LaB_6$ as the electron emissive material nor can any of the commercially available techniques. This is because $LaB_6$ is extremely reactive with the refractory metals, such as the foil of U.S. Pat. No. 4,215,457, normally used in securing electron emissive materials.

The present invention is particularly concerned with securing $LaB_6$ to a cathode tube of an electron gun. This material is much less sensitive to gas bursts and oil or metal vapours which can destroy in a short time active cathodes such as dispenser cathodes or oxide coated cathodes. Cathodes using $LaB_6$ material have been used in research laboratories, one common technique involving mounting an $LaB_6$ disc by press fit in a graphite mount and securing the graphite mount to a surrounding stainless steel ring using radially extending tungsten wires. This technique requires delicate fabrication steps and results in a device which is not rugged. In particular, the $LaB_6$ disc could become loose in its graphite mount resulting in a decrease in thermal conductivity.

OBJECTS AND SUMMARY OF THE INVENTION

It is an object of the present invention to provide a novel technique for mounting the $LaB_6$ material which results in a rugged device which is suitable for commercial applications.

It is another object of the invention to provide tools specifically designed to manufacture the novel mounting arrangement.

According to one aspect of the present, invention, there is provided a structure for supporting an $LaB_6$ electron emission disc within a hot cathode assembly of an electron gun, comprising a mounting member having a recess partly receiving snugly the $LaB_6$ disc, the disc and mounting member being received within a metal cathode tube and secured thereto by means of a radially inwardly extending lip formed at one end of the cathode tube and overlapping a portion of the disc and by means of indentations formed in the tube and extending into the mounting member.

The invention also involves novel tools for mounting the disc and mounting member to the tube and for sensing the tube to an alumina support ring.

DESCRIPTION OF THE PREFERRED EMBODIMENT

Figure 1:
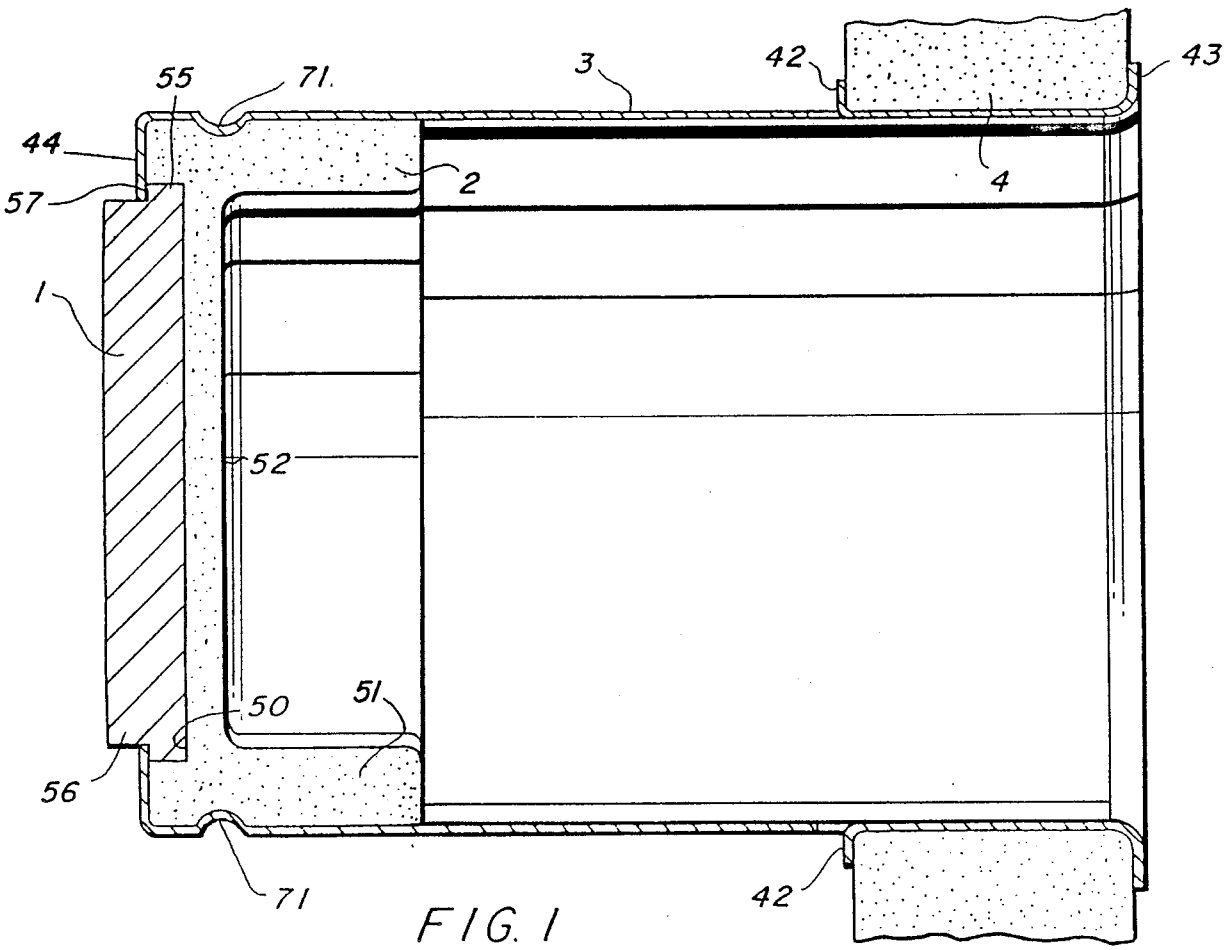
FIG. 1 is a longitudinal sectional view through a tube used to mount an $LaB_6$ material in an electron gun.

With reference firstly to FIG. 1, this shows an $LaB_6$ disc 1 secured in a high density graphite mount 2 which is in turn secured to a tube 3 of 50/50 molybdenum rhenium. Tube 3 is itself secured to an alumina support ring 4. It should be understood that support ring 4 is secured, in the completely assembled gun, to an outer control grid which surrounds tube 3 and has an apertured end cap spaced from disc 1 but, as the present invention does not involve the control grid or the method of securing the alumina support ring thereto, detailed description of these features is omitted. Similarly, the depiction of a heater filament which, in the completed assembly, would be disposed within tube 3 in close proximity to graphite mount 2, is omitted from FIG. 1 for clarity.

Figure 2:
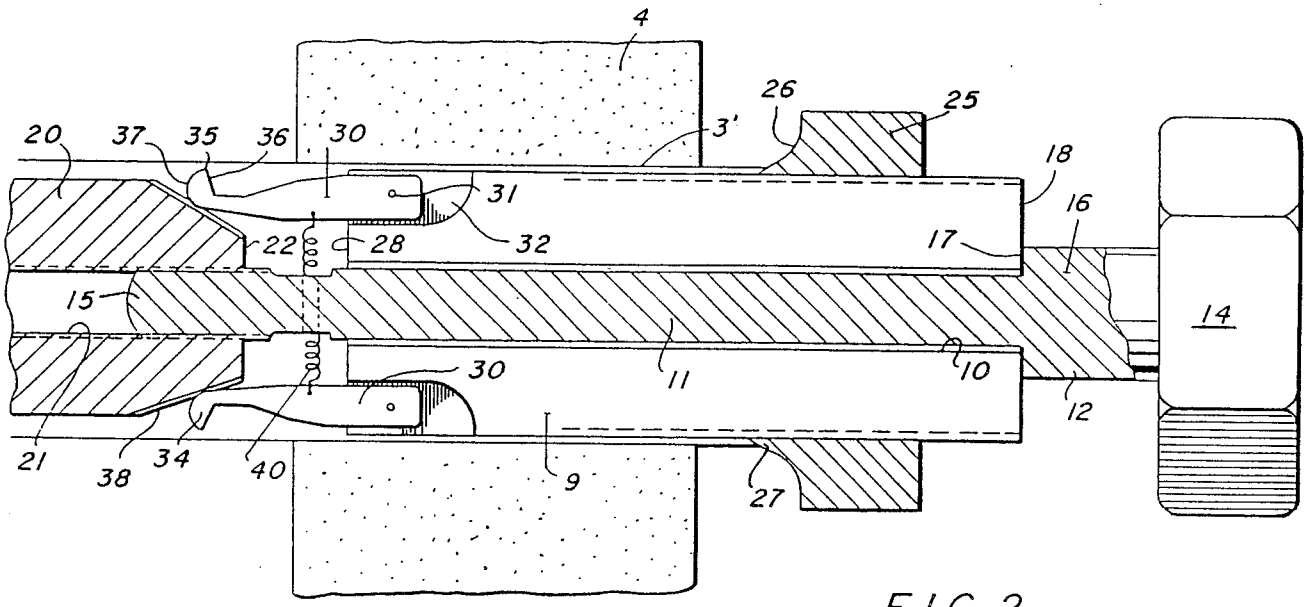
FIG. 2 is a fragmentary longitudinal sectional view of a first tool used in the assembling process.

FIG. 2 shows a tool 8 which is used to secure tube 3 to alumina ring 4. Tool 8 has an elongate, generally cylindrical, main body 9 having an axially extending through bore 10 which receives therethrough a stem portion 11 of a bolt-like member 12 which has a hexagonal head 14 at one end of the stem and a threaded free end portion 15 at the other end of the stem. Between the head 14 and the stem 11 is an increased diameter portion 16 defining a shoulder 17 which abuts an end face 18 of main body 9.

An elongate, generally cylindrical, auxiliary body 20 is aligned axially with main body 9 and has an external diameter generally similar (in the embodiment shown slightly smaller) to that of main body 9. Body 20 has an internally threaded hole 21 extending axially from one end 22 of body 20 and matingly receiving the threaded portion 15 of member 12.

Main body 9 has an external thread 24 extending from end face 18 and matingly receiving a nut 25 which has curved forward surface 26 culminating in a nose 27.

At the opposite end 28 from end 18, main body 9 is provided with at least two diametrically opposed lip cutting and forming members 30 which extend parallel to the longitudinal axis of the device and are each pivotally mounted at one end by means of a pivot pin 31 extending across a recess 32 in body 9. The free end of each member 30 is formed as a cutting head 34 having a pointed cutting surface 35 formed between an angular forming surface 36 and a curved cam follower surface 37.

Cam follower surfaces 37 are respectively received in cam grooves 38 which extend from small diameter end face 22 to the larger diameter circumference of auxiliary body 20. A retracting spring 40 extends between the mid-points of members 30. The centre of spring 40 is formed as a straight offset portion 40' to clear stem 11.

The following steps are followed to mount the cathode tube to alumina ring 4.

Figure 3:
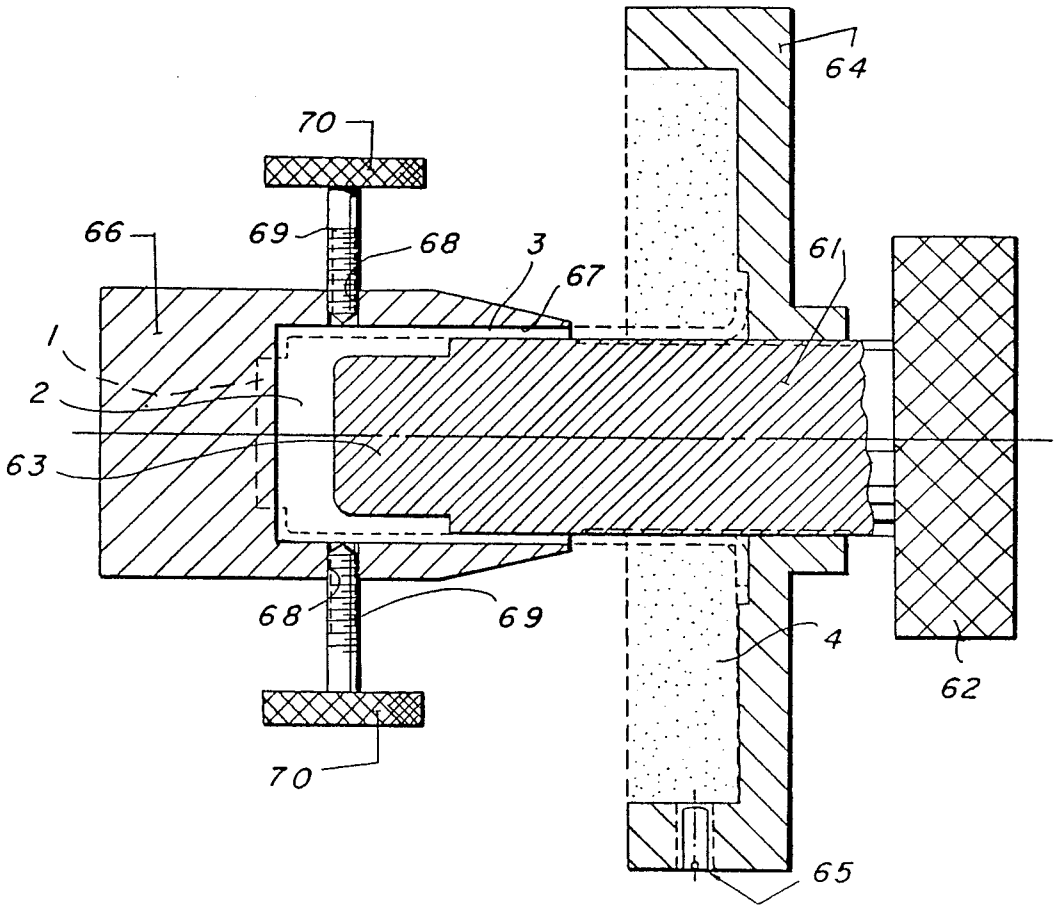
FIG. 3 is a fragmentary longitudinal sectional view of a second tool used in the assembling process.

1. A straight piece of 0.005" thick molybdenum/-rhenium tubing 3', the precursor of tube 3, is inserted into the bore of ring 4 such that a short end portion of tubing 3' projects to the right of ring 4 as seen in FIG. 2.
2. Tool 8 is inserted into tubing 3'.
3. Screw 25 is turned to adjust the distance between nose 27 and cutting point 35 such that, with nose 27 against tubing 3' an approximately equal amount of tubing 3' extends from ring 4 to cutting point 35 as from ring 4 to nose 27.
4. Nut 14 is turned clockwise to pull auxiliary body 20 to the right as shown in FIG. 2. Camming grooves 38 acting on surfaces 37 push cutting heads 34 outwardly so that lips are cut out of the tubing 3' by cutting points 35. Continued turning of head 14 causes surfaces 36 to fold over the lips 42 against one end of ring 4 as shown in FIG. 3.
5. Flaring screw 25 is turned clockwise so that a nose 27 pushes under tubing 3' and forms a flared end 43 which, as shown in FIG. 1, engages the other side of ring 4.
6. Head 6 is now turned counter clockwise permitting cutting heads to be fully retracted by means of spring 40.
7. The tool 8 is now removed. The support tubing 3' is now held firmly in alumina ring 4.

The next step that is carried out is the rolling of the free end of the tubing 3 to form the inward lip 44 shown in FIG. 1. Alternatively, the tubing 3 could be purchased with the lip 44 already formed. The rolling of lip 44 is done on a lathe using a spindle which fits inside tubing 3. Tubing 3' has now almost reached its final form and will now be referred to by numeral 3.

The graphite mount 2 has been prepared using conventional techniques. Mount 2 has an external diameter substantially identical or slightly smaller than the inside diameter of tube 3 and is formed with a recess 50 on its upper (left hand side of FIG. 1) surface for reception of an $LaB_6$ disc. The peripheral wall 51 may be extended beyond the bottom 52 of mount 2 for some distance as shown in FIG. 1.

All the inside surfaces of recess 50 and the inner portion of lip 44 are coated with colloidal graphite.

The $LaB_6$ disc has been prepared using conventional techniques. It is shaped to provide a greater diameter portion 55 and a smaller diameter portion 56 interconnected by a radial shoulder 57. The height of portion 55 is preferably substantially equal to the depth of the recess in mount 2. All of portion 55, shoulder 57 and the portion of portion 6 adjoining shoulder 57 may be coated with colloidal graphite in addition to or instead of coating ring 2 and lip 44 with colloidal graphite. The point is that there must be a layer of colloidal graphite between all contacting surfaces to ensure good electrical and thermal conductivity.

The tool which is used to secure disc 1 and mount 2 to tube 3 is shown in FIG. 3. This tool 60 has a rod 61 with a knurled head 62 at one end and shaped at the other end 63 in a complementary fashion to the underside (i.e., the side remote from disc 1) of mount 2. The outer surface of rod 61 is threaded and is matingly received in the threaded bore of a retaining ring 64 which is shaped and dimensioned to accommodate alumina ring 4. Three threaded holes 65 spaced 120° apart around the periphery of ring 62 are intended to receive set screws (not shown). An outer sleeve 66 has a blind bore 67 that is shaped and dimensioned to accommodate the disc 1, mount 2 and upper end portion (left hand side as seen in FIGS. 1 and 3) of tube 3 and two or more threaded holes 68 are provided in sleeve 66, the holes extending between the external surface of sleeve 66 and the bore 67. Each hole 68 receives an indentation forming device 69 formed similarly to a set screw and having, a knurled head 70.

With $LaB_6$ disc 1 pushed into the recess in mount 2, the following steps are carried out to secure this combination to the tube 3.

1. The assembly of disc 1 and mount 2 is placed inside tube 3 from the right with disc 1 projecting to the left as shown in FIG. 1. As shown, lip 44 of tube 3 extends completely across the unrecessed portion of mount 2 and overlaps shoulder 57 of disc 1.
2. Rod 61 of tool 60 is inserted into tube 3 from the right as shown in FIG. 3.
3. Retaining ring 64 is placed over alumina ring 4 and secured thereto by the set screws.
4. Rod 61 is now turned clockwise until graphite mount 2 is firmly seated on the end 63 of rod 61 as shown in FIG. 3.
5. Sleeve 66 is slipped over the left hand side of the support tube 3 containing the graphite mounted $LaB_6$ disc 1 with indentation forming devices 69 fully retracted as shown.
6. Indentation devices 69 are now turned clockwise until indentations 71 are formed in the side of tube 3 as shown in FIG. 1.
7. The tool 60 is now removed leaving the disc 1 and mount 2 assembly secured to tube 3. Mount 2 is secured by means of the indentations 71 and disc 1 is secured between mount 2 and overlapping lip 57 of tube 3.

The mounted $LaB_6$ electron emitter assembly can now be secured in an electron gun assembly in a conventional manner forming no part of the present invention.

The reason 50/50 molybdenum rhenium is used for the tube material is that it does not react significantly with the $LaB_6$ material. Additionally, 50/50 molybdenum rhenium can readily be spot welded and this permits convenient attachment to the tube of an electrical connector in a subsequent stage of assembly of the gun. Other materials such as pure rhenium, could be substituted for the molybdenum rhenium with perhaps less satisfactory results. Pure rhenium, for example, cannot easily be spot welded.

The colloidal graphite coating on the disc 1 acts as a chemical barrier material to lessen even further or prevent altogether reaction between the $LaB_6$ and the tube material, and also ensures good electrical and thermal conductivity but even without the colloidal graphite coating, the invention performs well at least when the tube material is 50/50 molybdenum rhenium and the mount 2 is made of graphite.

Instead of graphite, the mount 2 could be made of pure rhenium but it is believed that graphite works better.

As described, the lip 44 can be formed by rolling or the tube can be purchased with the lip already formed. Other techniques for providing the lip are envisaged. For example, a flat ring could be welded onto the undeformed end of the tube.

What I claim as my invention is:

1. A structure for supporting an $LaB_6$ electron emission disc within a hot cathode assembly of an electron gun, comprising a mounting member having a recess partly receiving snugly the $LaB_6$ disc, the disc and mounting member being received within a metal cathode tube and secured thereto by means of a radially inwardly extending lip formed at one end of the cathode tube and overlapping a portion of the disc and by means of indentations formed in the tube and extending into the mounting member.

2. A structure as claimed in claim 1 in which the disc is formed with a greater diameter portion and a smaller diameter portion interconnected by a radial shoulder, the greater diameter portion being received in the recess of the mounting member and the lip of the tube engaging the shoulder.

3. A structure as claimed in claim 2 in which the greater diameter portion has a thickness substantially equal to the depth of the recess.

4. A structure as claimed in claim 1, 2 or 3 in which the tube metal is 50/50 molybdenum rhenium and the mounting member is made of high density graphite.

5. A structure as claimed in claim 1, 2 or 3 in which all surfaces of the disc which contact the mounting member and the lip are coated with colloidal graphite.

6. A structure as claimed in claim 1, 2 or 3 in which the tube metal is 50/50 molybdenum rhenium, the mounting member is made of high density graphite and all surfaces of the disc which contact the mounting member and the lip are coated with colloidal graphite.

7. A structure as claimed in claim 1, 2 or 3 in which the tube is secured to an alumina support ring at an end portion of the tube remote from the disc and mounting member by means of outwardly directed lips cut and formed from the tube and by means of an outwardly flared end of the tube.

* * * * *